US008991914B2

(12) United States Patent
Grovender

(10) Patent No.: US 8,991,914 B2
(45) Date of Patent: Mar. 31, 2015

(54) POP-UP LOUNGE ARM ROOM FOR WATERCRAFT

(71) Applicant: Premier Marine, Inc., Wyoming, MN (US)

(72) Inventor: David L. Grovender, North Branch, MN (US)

(73) Assignee: Premier Marine, Inc., Wyoming, MN (US)

( * ) Notice: Subject to any disclaimer, the term of this patent is extended or adjusted under 35 U.S.C. 154(b) by 0 days.

(21) Appl. No.: 13/803,616

(22) Filed: Mar. 14, 2013

(65) Prior Publication Data

US 2014/0261146 A1 Sep. 18, 2014

(51) Int. Cl.

| | |
|---|---|
| ***A47C 13/00*** | (2006.01) |
| ***B60N 2/32*** | (2006.01) |
| ***A47C 7/62*** | (2006.01) |
| ***A47C 29/00*** | (2006.01) |
| ***B63B 17/02*** | (2006.01) |
| ***B63B 29/14*** | (2006.01) |

(52) U.S. Cl.

CPC ..... *B63B 29/14* (2013.01)

USPC ... 297/118; 297/139; 297/184.1; 297/184.14; 114/361; 114/363; 135/95; 135/96; 135/117; 135/147; 135/151; 135/153

(58) Field of Classification Search

USPC ..... 297/118, 129, 184.1, 184.11, 184.14, 297/184.15; 114/361, 363; 135/85, 95, 96, 135/117, 147, 148, 151, 153, 160

See application file for complete search history.

(56) References Cited

U.S. PATENT DOCUMENTS

| | | | | |
|---|---|---|---|---|
| 3,910,626 | A * | 10/1975 | Hobbensiefken | 297/118 X |
| 4,883,016 | A * | 11/1989 | Larson | 114/363 |
| 5,029,348 | A * | 7/1991 | Boren | 4/449 |
| 5,331,917 | A * | 7/1994 | Magers | 114/361 |
| 5,573,320 | A * | 11/1996 | Shearer | 297/184.14 X |
| 6,302,053 | B1 * | 10/2001 | Tomczak et al. | 114/363 |
| 6,681,713 | B2 * | 1/2004 | Scott et al. | 114/361 |
| 6,715,440 | B2 * | 4/2004 | Biedenweg et al. | 114/363 |
| 6,722,732 | B1 * | 4/2004 | Menne | 297/184.1 X |
| 7,117,646 | B2 * | 10/2006 | Blaisdell et al. | 114/361 X |
| 7,318,622 | B2 * | 1/2008 | Rezag et al. | 297/118 |
| 7,517,010 | B2 * | 4/2009 | Saint-Jalmes et al. | 297/118 |
| 7,641,278 | B2 * | 1/2010 | Strasser et al. | 297/184.14 |
| 7,837,259 | B2 * | 11/2010 | Staab et al. | 297/118 |
| 8,011,723 | B2 * | 9/2011 | Park et al. | 297/118 |
| 8,517,466 | B1 * | 8/2013 | Wizorek et al. | 297/118 X |
| 2009/0066121 | A1 * | 3/2009 | Jacob | 297/118 |
| 2009/0102256 | A1 * | 4/2009 | Staab et al. | 297/216.13 |
| 2013/0241246 | A1 * | 9/2013 | Round et al. | 297/63 |
| 2013/0241247 | A1 * | 9/2013 | Wallace et al. | 297/118 |
| 2013/0320724 | A1 * | 12/2013 | Plant | 297/232 |

* cited by examiner

*Primary Examiner* — Rodney B White

(74) *Attorney, Agent, or Firm* — Winthrop & Weinstine, P.A.

(57) ABSTRACT

The present invention relates generally to a device for providing a changing room and/or bathroom space on a watercraft. More specifically, a lounge chair is configured to open either manually or with aid of gas or air shocks in certain embodiments to reveal a changing room and/or bathroom space. On opening, a header bracket is released and deployed, in certain embodiments with aid of gas or air shocks, whereby the privacy curtain's substantially opaque and lightweight fabric is deployed around the revealed space.

18 Claims, 7 Drawing Sheets

POP-UP LOUNGE ARM ROOM FOR WATERCRAFT

RELATED APPLICATION

None

BACKGROUND OF THE INVENTION

1. Field of the Invention

The invention relates generally to a device for providing a changing room and/or bathroom space on a watercraft. More specifically, a lounge chair is configured to open, with aid of gas or air shocks in certain embodiments, to reveal a changing room and/or bathroom space. On opening, a header bracket is released, in certain embodiments with aid of gas or air shocks, whereby the cover fabric is deployed around the revealed space.

2. Description of the Related Art

BRIEF SUMMARY OF THE INVENTION

The present invention comprises a device for providing a hidden changing room and/or bathroom space on a watercraft. More specifically, a lounge chair is configured to open, with aid of gas or air shocks in certain embodiments, to reveal a changing room and/or bathroom space. On opening, a header bracket is released, in certain embodiments with aid of gas or air shocks, whereby the cover fabric is deployed around the revealed space to provide a privacy screen while the space is occupied.

The figures and the detailed description which follow more particularly exemplify these and other embodiments of the invention.

Figure 1:
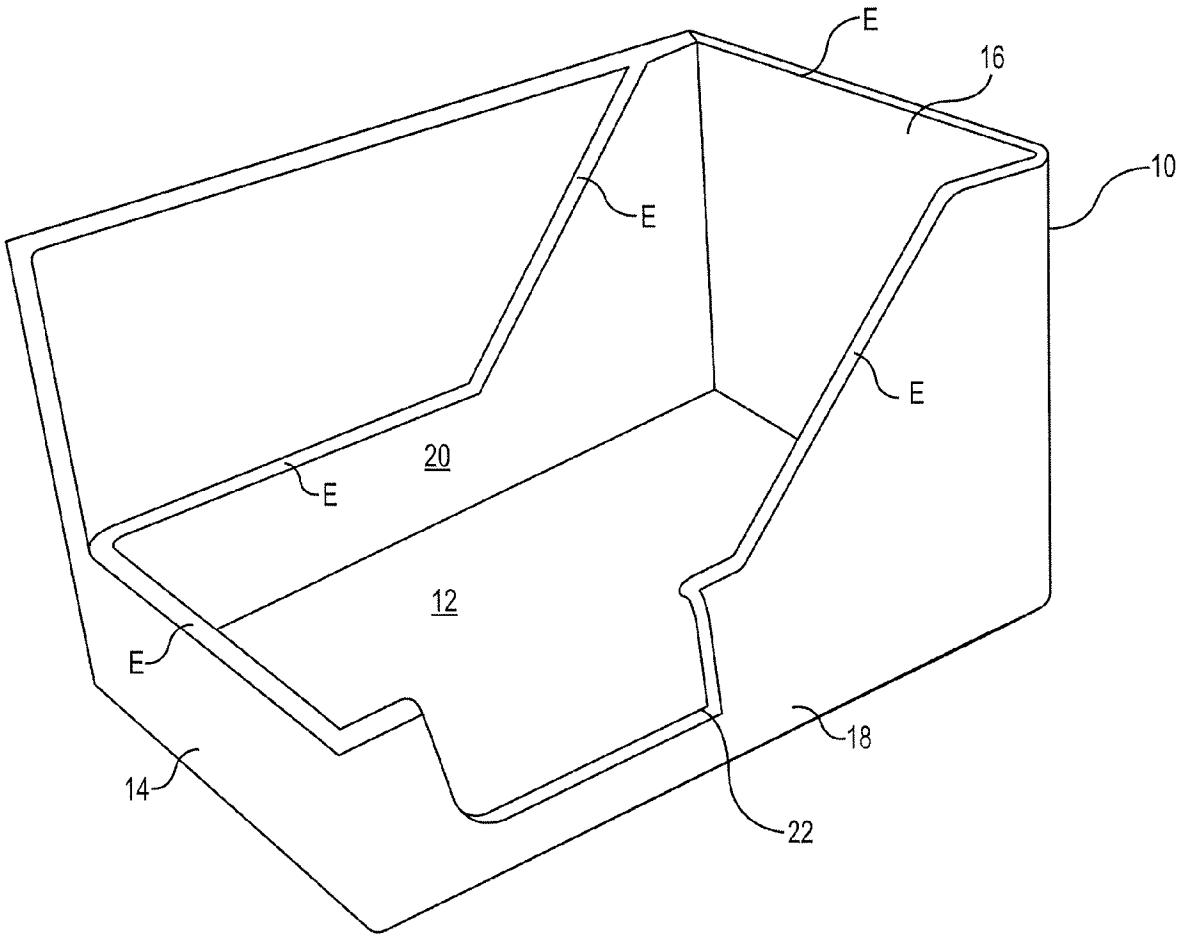
FIG. 1 illustrates a perspective view of one embodiment of the present invention.

The invention may be more completely understood in consideration of the following detailed description of various embodiments of the invention in connection with the accompanying drawings, which are as follows.

DETAILED DESCRIPTION OF THE INVENTION, INCLUDING THE BEST MODE

While the invention is amenable to various modifications and alternative forms, specifics thereof are shown by way of example in the drawings and described in detail herein. It should be understood, however, that the intention is not to limit the invention to the particular embodiments described. On the contrary, the intention is to cover all modifications, equivalents, and alternatives falling within the spirit and scope of the invention.

FIG. 1 provides a perspective view of one embodiment of a lounge arm frame 10 of the present invention comprising a floor 12 a front wall 14, a rear wall 16, and a pair of side walls 18, 20, wherein one of the side walls, in the illustrated embodiment side wall 18 further comprising a reduced elevation opening 22 for stepping access into the space. A surface edge E is defined on frame 10 as illustrated.

Figure 2:
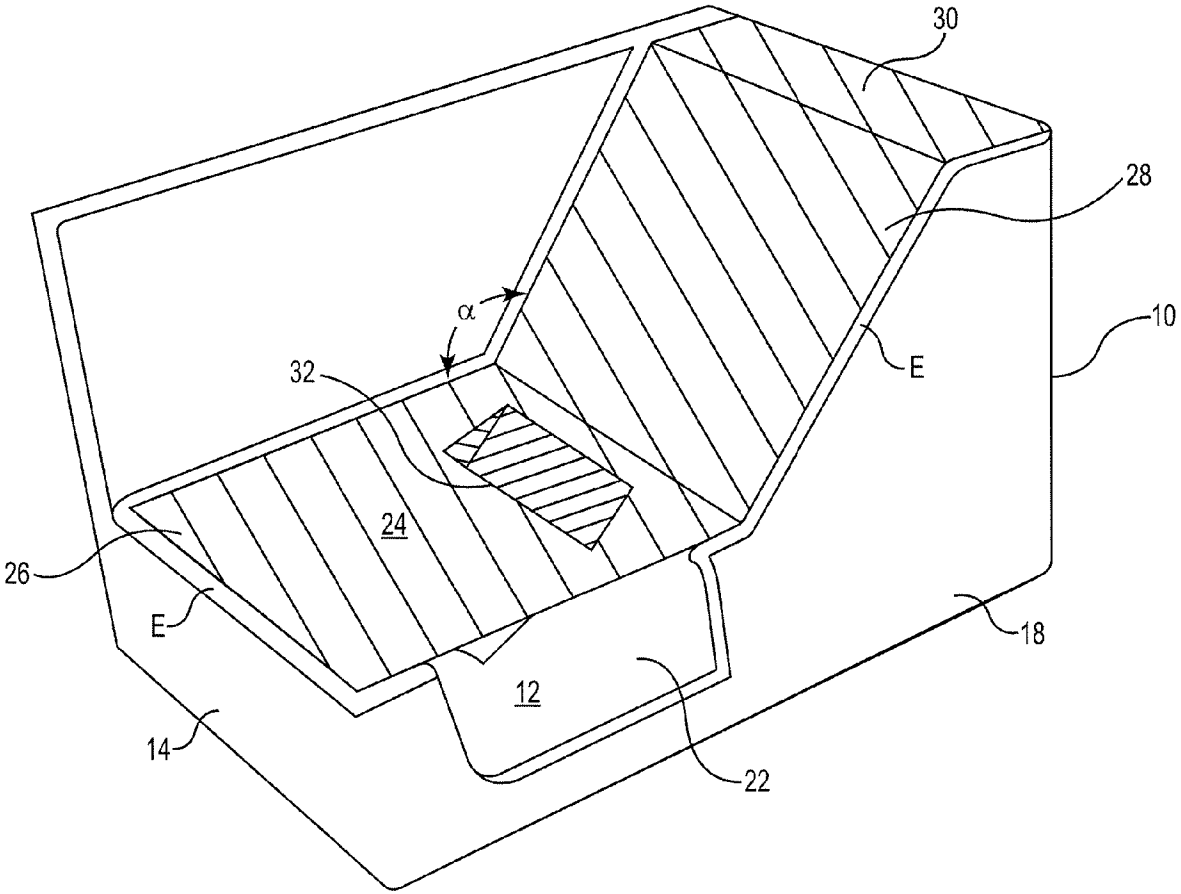
FIG. 2 illustrates a perspective view of one embodiment of the present invention.

FIG. 2 illustrates a substantially rigid seating frame 24, shown supported by frame's surface edge E so that the seating frame 24 is stably positioned on lounge arm frame 10. Seating frame comprises a lower portion 26, a medial portion 28 and an upper portion 30. Lower portion 26 may define a cutout 32 therein as shown in FIG. 2.

Lower portion 26 is substantially flat, serving to support the majority of the weight of a person seated thereon. Medial portion 28 is disposed at an obtuse angle $\alpha$ from the substantially flat lower portion 26 to facilitate a reclining posture for the person seated and supported thereon. Finally, upper portion 30 is, substantially flat and, therefore, is substantially parallel with the lower portion 26. As will be discussed further infra, upper portion 30 comprises a hinge, or hinges, or a pin or the equivalent, that allows the seating frame 24 to rotate away from lounge arm frame 10.

Figure 3:
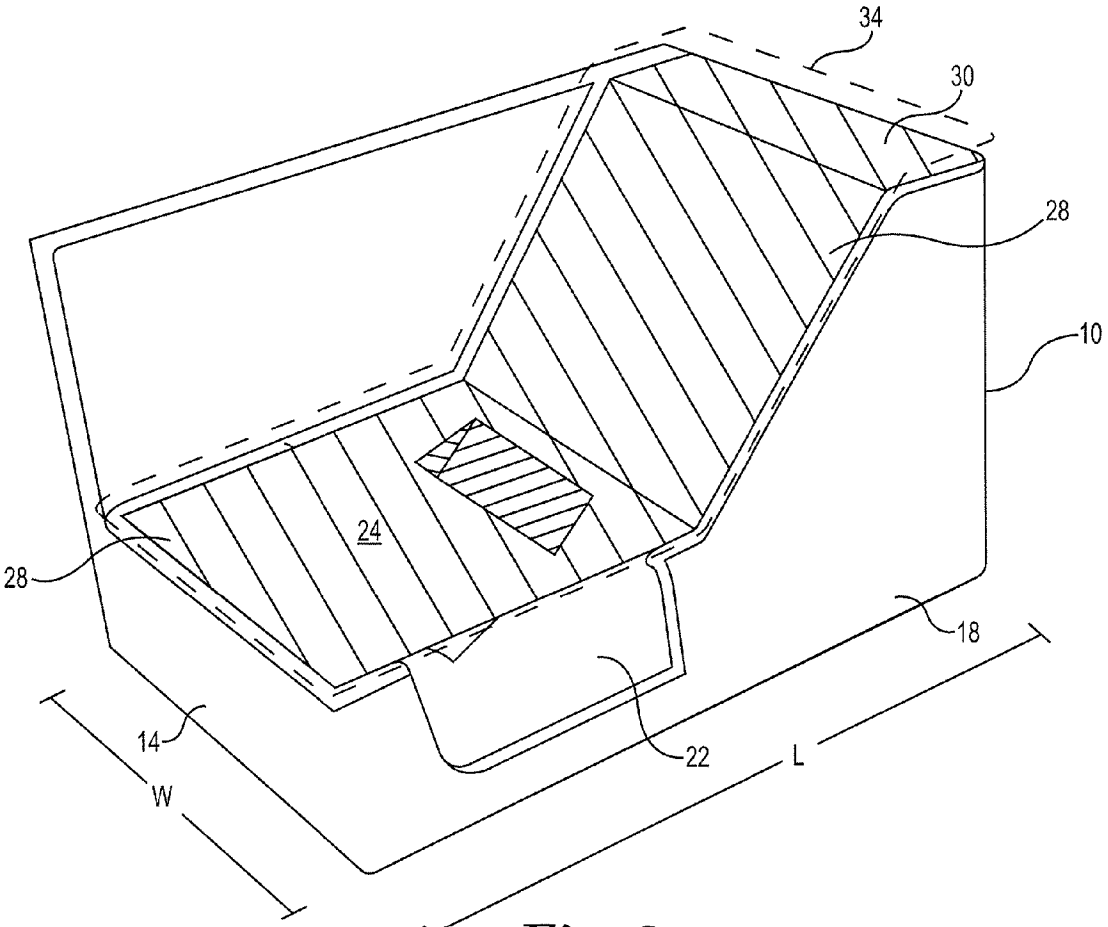
FIG. 3 illustrates a perspective view of one embodiment of the present invention.

With continuing reference to FIGS. 1 and 2, FIG. 3 illustrates in dashed lines a cushion or molded seat 34 secured to seating frame 24. Thus, the cushion or molded seat 34 will rotate together with seating frame 24 away from lounge chair frame 10 as discussed herein.

Figure 4:
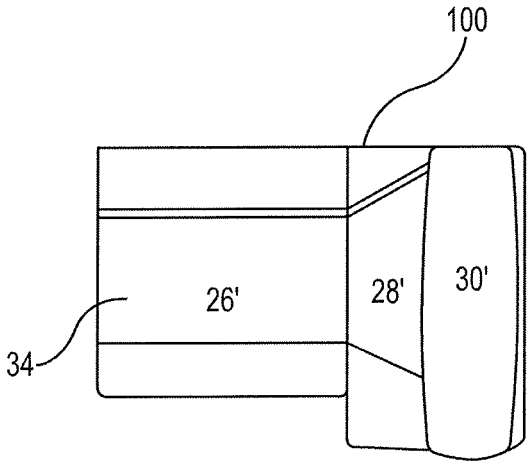
FIG. 4 illustrates a top view of one embodiment of the present invention.

FIG. 4 thus illustrates a top view of one embodiment of an assembled lounge chair 100 of the present invention. Seat cushion or molded seat 34 is illustrated as covering seating frame 24. More specifically, lower seat portion 26' is illustrated as covering lower portion 28 of seating frame 26, medial seat portion 28' is shown as covering medial portion 26 of seating frame 26 and upper seat portion 30' is shown covering at least a portion of upper portion 30 of seating frame 26.

Figure 5:
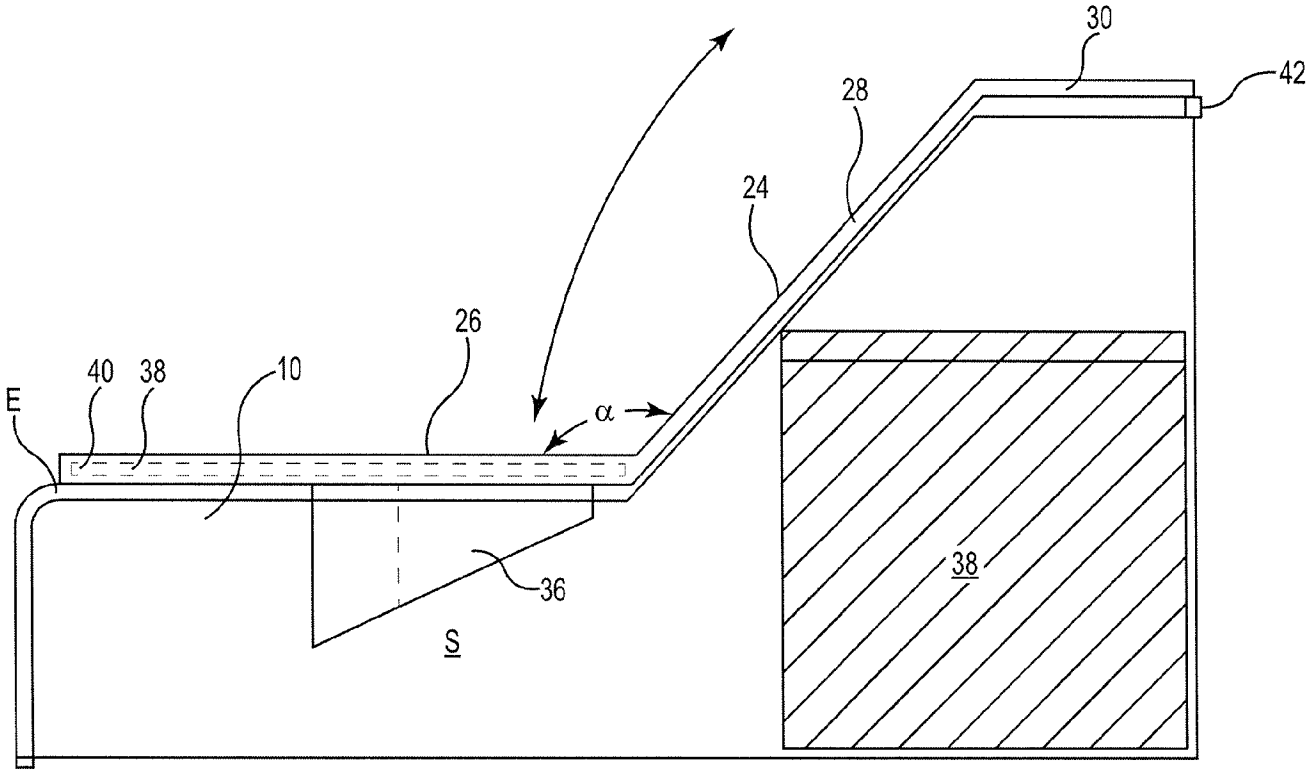
FIG. 5 illustrates a cutaway view of one embodiment of the present invention.

Turning now to FIG. 5, a cutaway side view showing the seating frame 24 in secured position on edge E of frame 10 in the closed position. Cutout 32 illustrated in FIGS. 2 and 3 is in operative communication with utility box 36 defined in seating frame 24 and extending below seating frame into space S. Utility box 36 may be at least partially hollow in order to provide space for storage of items. Further, the outer surface of utility box may comprise a mirror. Space S may further comprise a toilet 38 as is well known in the art.

A header bracket 38 is illustrated in dashed lines as stowed in the lower portion 26 of seating frame 24 in the closed position of FIG. 5. Header bracket 38 comprises a rotating securement to the lower portion 26 by a pin 40 or other well-known equivalent arrangement to the skilled artisan allowing the header bracket to rotate about the securement point. Header bracket 38 comprises, as will be discussed infra, a substantially opaque, but lightweight and breathable fabric privacy curtain attached around header bracket 38. Privacy curtain automatically deploys when the user pulls header bracket 38 from its stowed location to its open and deployed position.

Another rotational mechanism is provided as, for example, a hinge 42, or other equivalent structure, that is attached to both the edge E of frame 10 and to the upper portion 30 of seating frame 24. This hinge 42, for example, provides a pivot point for rotation of the entire seating frame upwardly from the closed position shown in FIG. 5 to an open position as will be discussed in connection with FIG. 6.

In the embodiment shown in FIG. 5, if the user applies sufficient force to overcome the mass of seating frame 24, seating frame 24 will rotate upward to a point where it will remain open.

The assembled lounge chair 100 may be opened by applying generally vertical force at any point along the lower portion 26, or even the medial portion 28. The longer the lever arm, the less force is required, so lifting near the header bracket's 38 connection pin 40 is most efficient as the skilled artisan will readily ascertain.

Figure 6:
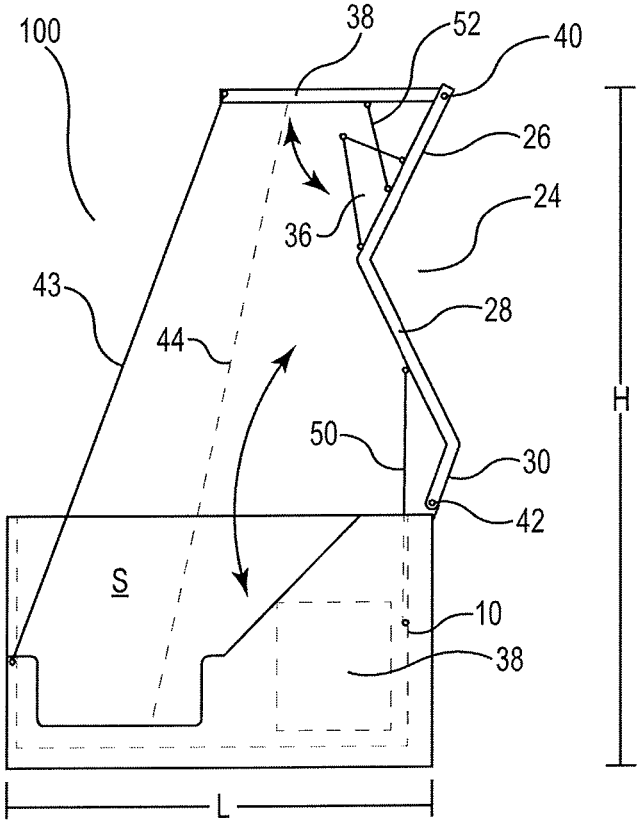
FIG. 6 illustrates a side view of one embodiment of the present invention.

As described above, when the seating frame 24 is opened, stowed header bracket 38 is exposed and the user may manually open and deploy header bracket 38 which carries privacy curtain 43. Privacy curtain 43 is also connected to the frame 10 at one or more locations. As illustrated in FIG. 6, the device 100 is in a fully deployed position with privacy curtain 43 affixed to both the deployed header bracket 38 and frame 10. As the skilled artisan will appreciate, this arrangement allows the privacy curtain 43 to be pulled between frame 10 and header bracket 38, creating temporary walls within space S revealed on opening of the seating frame 24. Privacy curtain 43 may comprise a privacy curtain access 44 on the side of the reduced elevation access opening 22 to facilitate ease of entry into the now private space S. Privacy curtain access 44 may comprise, for example, a zipper or Velcro, without limitation.

The above embodiment contemplates manually deploying the seating frame 24 and the header bracket 38, with privacy curtain 43. FIG. 6 illustrates another embodiment with assisted lifting and deployment capabilities. Thus, at least one, preferably two, gas or air shock absorbing elements 50 may be disposed between the medial portion 28 of seating frame 24 and frame 10. In this embodiment, the shock absorbing element(s) provide a biasing upward force against the medial portion 28 so that when the user begins lifting seating frame 24 by application of force thereto, the shock absorbing element(s) 50 essentially take over, pushing the seating frame 24 upward slowly and smoothly into the open deployed position illustrated in FIG. 6. Overcoming the upward bias of the shock absorbing element(s) 50 by pressing downward on the frame 24 with sufficient force results in the seating frame 24 returning to the closed position shown in e.g., FIG. 5.

Moreover, other embodiments of device 100 may also include an assist mechanism for deploying the header bracket 38. Thus, with reference to the previous Figures, FIG. 6 shows another at least one, preferably two, gas or air shock absorbing elements 52 disposed between header bracket 38 and upper lower portion 26 of seating frame 24 with a biasing force tending to drive the header bracket 38 out of its stowed position. In this embodiment, as the user initiates the opening and deployment of device 100, initially the shock absorbing element(s) 50, 52 both begin to extend. Element(s) 52 applying pressure to the header bracket 38, moving it out of the stowed position to the open and deployed position of FIG. 6. This also deploys the privacy curtain 43. When the user is finished with the changing and/or restroom space S, he or she simply restows the header bracket 38 by overcoming the biasing force of element(s) 52, restowing header bracket 38. Then, as above, pulling downward on seating frame 24 with a force sufficient to overcome the biasing force of element(s) 50 until the seating frame 24 and device achieves the closed position.

Figure 7:
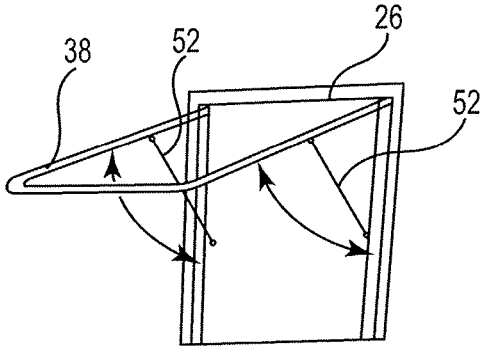
FIG. 7 illustrates a partial perspective view of one embodiment of the present invention.

FIG. 7 illustrates one embodiment of header bracket 38 as a U-bracket, rotatingly attached to lower portion 26 of seating frame as discussed above. Channels 60 align with the header bracket 38 so that when header bracket 38 is stowed, the arms A of header bracket 38 rotate to fit within channels 60 and may be rotated out of channels 60 to deploy, as is illustrated by the double-headed arrows. Shock absorbing elements 52 are also illustrated.

Space S may be defined as closed space S when, as in FIG. 5, seating frame 24 is in the closed position wherein lower portion 26 of seating frame 24 engages the upper edges E of frame 10. In this case, space S is defined by the frame 10 and the seating frame 24.

Space S may be further defined as open space S when, as in FIG. 6, seating frame 24 is rotated upwardly away from upper edges E of frame 10 to the open and deployed position of FIG. 6. In this case, space S is defined by the frame 10, the opened seating frame 24 and the deployed privacy curtain 43.

Closed space S comprises a volume and open space S also defines a volume. However, open space S comprises a volume that is larger than the volume of closed space S.

One of the advantages of the present invention is that it provides a far larger space S for changing and/or using the toilet, etc., than prior pop-up changing rooms. The most preferred size of space S in the deployed, open state of FIG. 6 comprises a height H of within the range of 75 to 80 inches, with 77 inches being most optimal. The most preferred length L of space S is in the range of 44 to 52 inches, with 48 inches being most optimal. Finally, space S, as is best shown in FIG. 3, comprises a most preferred width S in the range of 24 to 32 inches, with 28 inches being most optimal.

The present invention should not be considered limited to the particular examples described above, but rather should be understood to cover all aspects of the invention. Various modifications, equivalent processes, as well as numerous structures to which the present invention may be applicable will be readily apparent to those of skill in the art to which the present invention is directed upon review of the present specification.

What is claimed is:

1. A device for creating a pop-up changing and/or restroom space for a watercraft lounge arm chair, comprising:

a lounge arm chair frame having an upper edge thereon, a floor, a front wall, a rear wall, two side walls, one of side walls defining a reduced elevation opening therein;

a rigid seating frame disposed on the upper edge of the lounge arm chair frame, the rigid seating frame comprising a lower portion, a medial portion and an upper portion;

a rotational mechanism attached to both the upper edge of frame and to the upper portion of rigid seating frame, wherein the rigid seating frame may rotate around the rotational mechanism;

a header bracket rotationally mounted to the lower portion of rigid seating frame wherein the header bracket further comprises a U-bracket and wherein the lower portion of rigid seating frame comprises channels, wherein the U-bracket may be disposed and thereby stowed; and a privacy curtain operationally disposed around header bracket and affixed to the rigid seating frame, wherein the seating frame of the chair may comprise a closed position, wherein the lower portion, medial portion and upper portions of rigid seating frame engage upper edge of the lounge chair frame, wherein the seating frame of the chair may comprise an open, deployed position, wherein the lower portion, medial portion and upper portions of rigid seating frame are rotated by rotational mechanism upwardly away from the upper edge of the lounge chair frame and, wherein the privacy curtain is fully deployed.

2. The device of claim 1, further comprising a closed space when seating frame of chair is in the closed position, wherein the closed space is defined by the chair frame and the seating frame.

3. The device of claim 2, wherein the opened deployed space comprises:

a width in the range of 24 inches to 32 inches;

a length in the range of 44 inches to 52 inches; and a height in the range of 75 inches to 80 inches.

4. The device of claim 3, wherein the opened deployed space comprises:

a width of approximately 28 inches;

a length of approximately 48 inches; and a height of approximately 77 inches.

5. The device of claim 1, further comprising an open deployed space, that is larger than the closed space and is achieved when seating frame is rotated upwardly away from upper edges of chair frame to the open, deployed position, wherein the open, deployed space is defined by the chair frame, the opened seating frame and the deployed privacy curtain.

6. The device of claim 1, further comprising at least one shock absorbing element operationally disposed between the lounge arm chair frame and the medial portion of the rigid seating frame, wherein the at least one shock absorbing element comprises a biasing force in the generally upward direction to assist in opening the rigid seating frame to the open, deployed position.

7. The device of claim 6, further comprising two shock absorbing elements.

8. The device of claim 1, further comprising at least one shock absorbing element operationally disposed between the lounge arm chair frame and the lower portion of the rigid seating frame, wherein the at least one shock absorbing element comprises a biasing force in the generally upward direction to assist in deploying the header bracket and privacy curtain.

9. The device of claim 8, further comprising two shock absorbing elements.

10. The device of claim 8, further comprising at least one shock absorbing element operationally disposed between the lounge arm chair frame and the lower portion of the rigid seating frame, wherein the at least one shock absorbing element comprises a biasing force in the generally upward direction, to assist in deploying the header bracket and privacy curtain.

11. The device of claim 10, wherein the at least one shock absorbing element comprises an air or gas shock absorbing element.

12. The device of claim 8, further comprising two shock absorbing elements.

13. The device of claim 1, wherein the, medial portion of the rigid seating frame further defines a cutout.

14. The device of claim 13, wherein the cutout corresponds to a utility box defined in space, wherein at least a portion of the utility box is hollow.

15. A device for creating a pop-up changing and/or restroom space for a watercraft lounge arm chair, comprising:

a lounge arm chair frame having an upper edge thereon, a floor, a front wall, a rear wall, two side walls, one of side walls defining a reduced elevation opening therein;

a rigid seating frame disposed on the upper edge of the lounge arm chair frame, the rigid seating frame comprising a lower portion, a medial portion and an upper portion;

a rotational mechanism attached to both the upper edge of frame and to the upper portion of rigid seating frame, wherein the rigid seating frame may rotate around the rotational mechanism;

a header bracket rotationally mounted to the lower portion of rigid seating frame, wherein the header bracket further comprises a U-bracket and wherein the lower portion of rigid seating frame comprises channels, wherein the U-bracket may be disposed and thereby stowed; and a privacy curtain operationally disposed around header bracket and affixed to the rigid seating frame, wherein the seating frame of the chair may comprise a closed position, wherein the lower portion, medial portion and upper portions of rigid seating frame engage upper edge of the lounge chair frame, and wherein the seating frame of the chair may comprise an open, deployed position, wherein the lower portion, medial portion and upper portions of rigid seating frame are rotated by rotational mechanism upwardly away from the upper edge of the lounge chair frame and, wherein the privacy curtain is fully deployed;

a closed space having a volume and achieved when seating frame of chair is in the closed position, wherein the closed space is defined by the chair frame and the seating frame;

an open deployed space having a volume that is a larger volume space than the closed space and is achieved when seating frame is rotated upwardly away from upper edges of chair frame to the open, deployed position, wherein the open, deployed space is defined by the chair frame, the opened seating frame and the deployed privacy curtain;

at least one shock absorbing element operationally disposed between the lounge arm chair frame and the medial portion of the rigid seating frame, wherein the at least one shock absorbing element comprises a biasing force in the generally upward direction to assist in opening the rigid seating frame to the open, deployed position;

at least one shock absorbing element operationally disposed between the lounge arm chair frame and the lower portion of the rigid seating frame, wherein the at least one shock absorbing element comprises a biasing force in the generally upward direction to assist in deploying the header bracket and privacy curtain.

16. The device of claim 15, wherein the opened deployed space comprises:

a width in the range of 24 inches to 32 inches;

a length in the range of 44 inches to 52 inches; and a height in the range of 75 inches to 80 inches.

17. The device of claim 15, wherein the opened deployed space comprises:

a width of approximately 28 inches;

a length of approximately 48 inches; and a height of approximately 77 inches.

18. The device of claim 15, wherein the shock absorbing elements are gas or air shock absorbing elements.

* * * * *